US005131303A

United States Patent [19]

Wilson et al.

[11] Patent Number: 5,131,303

[45] Date of Patent: Jul. 21, 1992

[54] PUNCH ASSEMBLY

[75] Inventors: Kenneth J. Wilson, White Bear Lake; Verlon Robinson, Anoka, both of Minn.

[73] Assignee: Wilson Tool International, White Bear Lake, Minn.

[21] Appl. No.: 743,689

[22] Filed: Aug. 12, 1991

[51] Int. Cl.[5] ..... B26F 1/14

[52] U.S. Cl. ..... 83/140; 83/527; 83/700

[58] Field of Search ..... 83/138–141, 83/527, 530, 700

[56] References Cited

U.S. PATENT DOCUMENTS

| | | | |
|---|---|---|---|
| 3,848,496 | 11/1974 | Stevens et al. | 83/133 |
| 3,926,082 | 12/1975 | von Langendorff | 83/140 |
| 4,012,975 | 3/1977 | LaLone | 83/140 |
| 4,031,787 | 6/1977 | Cady | 83/140 |
| 4,141,264 | 2/1979 | Weisbeck | 83/23 |
| 4,375,774 | 3/1983 | Wilson et al. | 83/140 |
| 4,377,957 | 3/1983 | Wheeler | 83/103 |
| 4,440,052 | 4/1984 | Weisbeck | 83/140 |
| 5,020,407 | 6/1991 | Brinlee | 83/700 |
| 5,054,347 | 10/1991 | Johnson et al. | 83/140 |

*Primary Examiner*—Hien H. Phan

*Attorney, Agent, or Firm*—James R. Haller; Gregory P. Kaihoi; Edward S. Hotchkiss

[57] ABSTRACT

A punch assembly for use in a punch press including a pair of elongated rods having mating respective male and female threaded ends, a head on one end of the female portion for being engaged by a ram of the press, a compression spring, a punch tip at the end of the male portion for action with a workpiece, a punch guide encompassing part of the punch assembly to act as a stripper in relation between the punch tip and the workpiece and a wire clip co-acting between the male and female threaded portions for adjustment of the overall punch length. After sharpening, the wire clip is disengaged and the male and female rods are axially rotated in oposite directions to compensate for the ground-off length. The wire clip is then reengaged and the punch assembly is reassembled for use.

10 Claims, 2 Drawing Sheets

PUNCH ASSEMBLY

TECHNICAL FIELD

The invention relates to punch assemblies used in punch presses.

BACKGROUND OF THE INVENTION

Repeated use of a punch assembly in a punch press operation results in the natural dulling and wear of the punch tip. Once the tip has become dull, the effectiveness of the punch assembly is reduced and the punch tip must be sharpened. Sharpening may be accomplished by grinding the end of the punch tip, and this results in shortening the length of the punch. The length of the punch then must be adjusted to compensate for the ground-off portion.

Punch assemblies that allow for length corrections are exemplified in U.S. Pat. No. Re 29,958. This reference compensates for the lost punch length by adding washers or other similar objects to the punch. The problem with this method is that the added washers or the like are usually weak and cannot withstand the constant cyclical forces placed upon a punch. Also, the length of the punch tip can only be adjusted within certain limits before it becomes too short for effective operation, thereby limiting the number of times the punch tip can be sharpened.

Most known methods that allow for the adjustment of the length of the punch tip require dismantling of the entire punch in order to access the punch tip for adjustment this obviously can be a rather time consuming process. Additionally, once the punch has been reassembled further effort is frequently expended in determining how much the sharpening and adjusting steps have affected the position of the tip. A need exists, therefore, for an accurate means of adjusting the length of the punch in a manner that is not overly time consuming or difficult.

SUMMARY OF THE INVENTION

The present invention provides a readily adjustable punch assembly for use in a punch press. The assembly includes a punch comprising a pair of elongated rods having mating respective male and female threaded ends, such that the overall length of the punch may be altered by rotating one rod with respect to the other, one of the threaded rods having at its other end a punch tip. The punch is axially slidingly received within a bore provided in a punch guide. The punch assembly includes releasable lock means for locking the threaded ends against relative rotation. The lock means is movable between a locked position, in which the threaded rod ends are locked against relative rotation, and an unlocked position, wherein relative rotation of the threaded ends is permitted for adjusting the length of the punch. Position maintaining means are carried by the punch guide and serve to maintain the lock means in its locked position when the punch is operatively positioned in the punch guide.

DETAILED DESCRIPTION OF THE INVENTION

The principles of this invention relate to the workings of a punch and stripper assembly. Accordingly, the invention is appropriate for the numerous applications concerning punch presses, including, but not limited to, single station and turret presses.

Figure 1:
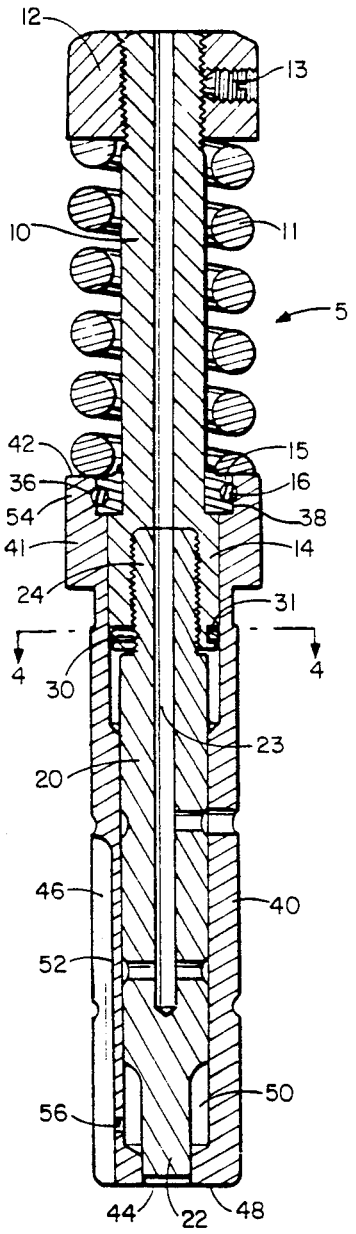
FIG. 1 is an axial cross-sectional view of a punch assembly of the invention before sharpening.
Figure 2:
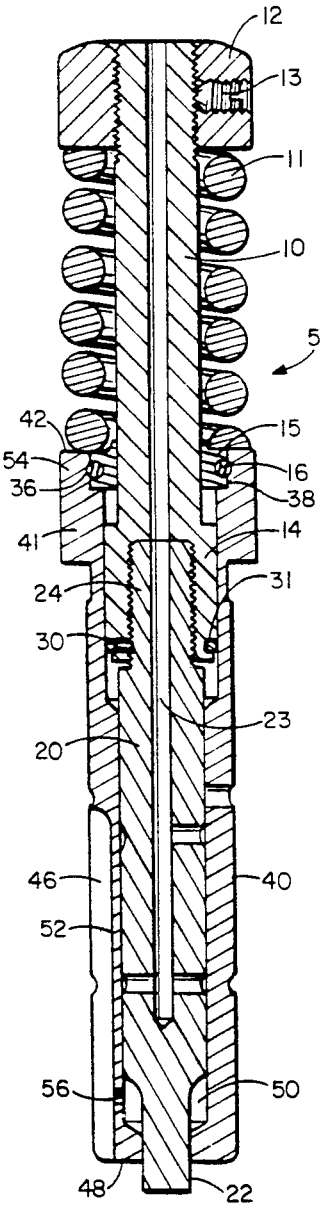
FIG. 2 is an axial cross-sectional view of the punch assembly of FIG. 1 with a force imparted on its head.
Figure 3:
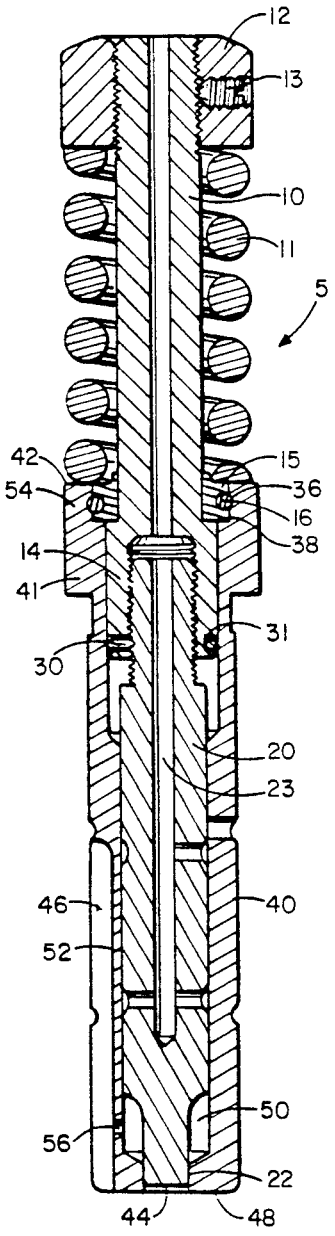
FIG. 3 is an axial cross-sectional view of the punch assembly of FIGS. 1 and 2 after sharpening.

A punch assembly of the present invention is exemplified in FIGS. 1—3 as comprising a punch (5) having a punch holder (10) and a punch body (20); a locking means (30); and a punch guide (40). In operation, a ram (not shown) strikes downwardly on the head (12) of the punch holder, compressing the compression spring (11) and urging the punch downwardly until the punch tip (22) protrudes below the lower face (48) of the punch guide (40), as shown in FIG. 2. The protruding punch tip (22) passes through a workpiece (not shown) of a sheet material and into a die casting (not shown) to punch an item out of the workpiece having the desired shape. The punch assembly is adaptable to a variety of punch tip shapes depending upon the shape desired to be removed from the workpiece. The ram is then retracted, releasing the compressive force on the spring (11). The spring then acts against the head (12), which it abuts, to draw the punch upward. When the punch tip (22) is retracted upwardly through the aperture (44) in the punch guide, the lower face (48) of the guide acts as a "stripper plate," i.e., it engages the workpiece, which often sticks to the retreating punch, and separates it from the punch tip.

As can be seen in FIGS. 1-3, the punch assembly is comprised of individual units joined together. The punch holder (10) consists of an axially elongated shaft terminating in a female threaded end (14). At the opposite end is a head (12) of increased diameter that is axially adjustable in relation to the punch holder (10). The external circumferential surface of the head (12) is textured to facilitate the frictional resistance force required when the head needs to be loosened from the assembly. A set screw (13) is embedded in the head (12) perpendicular to the axis of the punch holder (10). The set screw (13) acts to removably affix the head (12) in place about the punch holder after it has been axially positioned along the punch holder to achieve the desired compressive force on the spring (11). The spring (11) is wrapped around the shaft of the punch holder (10) in a helical fashion.

The punch body (20) consists of an elongated shaft tapering to a lower sharpened tip (22) which is configured in the shape of the item to be punched out of the workpiece. The punch body (20) is retained and axially slidable within the bore (50) of the punch guide (40). The punch tip (22) is capable of extending through an axially aligned aperture (44) located in the base of the punch guide (40). A male threaded end (24) is located at the end opposite the punch tip (22) and extends axially upwardly into the female threaded end (14) defining the lower portion of the punch holder (10).

The male threaded portion is sized to be matingly received within the female threaded end (14), and the threads on the male and female portions are adapted to matingly engage one another. As the punch holder (10) is rotated with respect to the punch body (20), the punch body will move axially with respect to the punch holder. If the pitch of the mating threads is known, the relationship between the degree of relative rotation of these members and the resultant axial movement can be readily determined. Thus, the overall length of the punch can be precisely adjusted by axially rotating the punch holder (10) with respect to the punch body (20) through a known angle.

If so desired, a central shaft (23) can extend from the top of the head (12) axially through the punch holder (10) and most of the punch body (20). The shaft may be linked to connecting holes and can be used as an aid in lubricating the assembly. The shaft can be of any suitable dimension for this purpose; a 5/32 inch diameter hole has been found to work well.

The punch assembly further comprises a generally tubular punch guide (40). The punch body (20) and a lower portion of the punch holder (10), including the threaded female portion (14) are slidably received within the guide. An upper portion (41) of the guide desirably extends radially outwardly of the punch (5) to define a generally upwardly facing annular shoulder (42). This shoulder (42) generally faces the head (12) and abuts the end of the compression spring (11) opposite the head so that the spring (11) is retained in compression between the opposed surfaces of the head (12) and the annular shoulder (42) of the punch guide.

On the outer surface of the punch guide is a generally U-shaped positioning groove (46) that permits the guide to be accurately positioned in a punch turret (not shown) when the punch assembly is mounted thereon. In a preferred embodiment, the groove extends generally parallel to the axis of the substantially cylindrical punch guide and includes a generally flat face (52). A bolt or a mating projection provided on the punch turret may be received within the groove and engage the flat face to limit rotational displacement of the guide with respect to the turret.

A vent (56) is situated on the lower portion of the flat face (52) of the positioning groove (46) near the end closest to the punch tip (22). In the preferred embodiment, the vent is desirably of a generally circular slope and extends perpendicular to the axis of the punch guide (40) entirely through the punch guide (40). The punch tip (22) acts as a seal with the punch guide aperture (44) and the vent (56) allows any gasses that build up during the operation of the punch assembly to be discharged to the surrounding air.

If so desired, a protective sheath (not shown) that is slidably receivable about the guide may be used to protect the guide during transporation Although the sheath can be constructed of any appropriate shape and material, it is desirably made of a plastic wire mesh and extends past the guide pore. Such a construction protects the punch guide and tip from possible abrasion impacts during shipping, as well as protecting handlers from possible cut from the sharp tip (22) or positioning groove (46).

The guide (40) is desirably removably attached to the punch (5) in a manner which permits the punch to move axially within the guide during operation In a preferred embodiment, a compressible O-ring (16), which may be formed of neoprene or the like, is utilized. The O-ring may be maintained in a position disposed above the female threaded end (14) of the punch holder by an annular O-ring slot (15). The O-ring slot is adapted to be slidably received about the punch holder (10) and abut the top of the female threaded end (14) and an inner shoulder (54) of the punch guide when the punch is in its rest position (shown in FIG. 1).

The O-ring slot (15) is held in an abutting relationship with the female end (14) and the shoulder (54) by the force of the compression spring (11). When the punch is depressed during operation, as shown in FIG. 2, movement of the slot (15) will continue to be limited by the inner shoulder of the punch guide; when the punch guide is removed from the punch (5) as outlined below, the female end (14) of the punch holder will limit movement of the holder.

An O-ring seat (36) is provided on the inner wall (38) of the upper portion (41) of the guide and is adapted to receive the O-ring (16) when the O-ring slot (15) abuts the inner shoulder (54) of the guide. The portion of the inner wall disposed above the O-ring seat (36) desirably has an inner diameter slightly less than the outer diameter of the O-ring. As noted above, the O-ring is formed of a compressible material such as neoprene. This permits the O-ring to yield inwardly as the guide is slid upwardly about the punch during assembly of the invention. When the O-ring reaches the seat (36) on the guide, it will expand into and engage the seat to restrict movement of the punch guide with respect to the O-ring slot (15), and hence the punch (5). If one desires to remove the punch guide (40) from the punch assembly, one may pull downwardly on the guide while holding the punch stationary. If sufficient force is applied, the O-ring will yield in compression and permit the guide to be retracted from its position about the punch.

Figure 4:
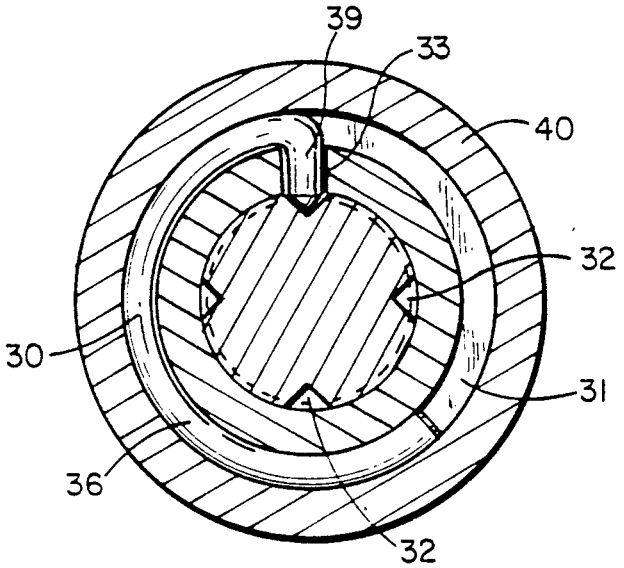
FIG. 4 is a cross-sectional view of a lock means of the invention taken along line 4—4 of FIG. 1.
Figure 5:
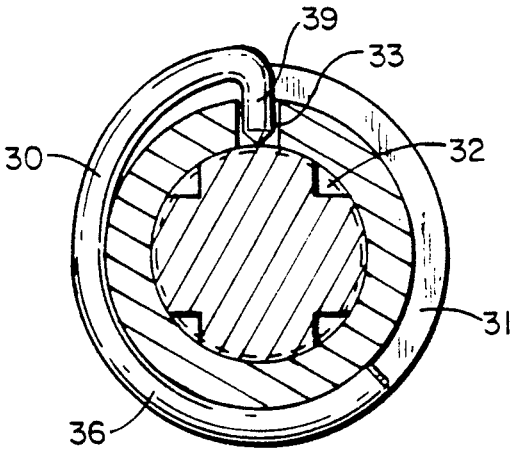
FIG. 5 is a cross sectional view of the lock means shown in FIG. 4 in its unlocked position.

As noted above the overall punch length can be adjusted by rotating the punch holder (10) and punch body (20) members with respect to one another. In order to maintain the punch at a constant length during use, therefore, locking means are provided to restrict relative rotation between the punch holder and punch body. Any of a wide variety of locking means may be employed, but a preferred embodiment utilizes an arcuate wire clip (30). Referring to FIGS. 4 and 5, the clip desirably comprises a generally C-shaped, semicircular body (36) and a generally radially inwardly extending cam pin (39). For reasons explained below, the body (36) of the clip preferably extends through an arc of more than 180°. The clip is desirably integrally formed of a springy, resilient material, such as stainless steel or the like.

The female threaded end (14) of the punch holder includes an annular groove (31) within which the body (36) of the clip may be fully received so that it does not extend significantly beyond the outer perimeter of the rest of the generally cylindrical female end (14). An aperture (33) extends generally radially inwardly through the female end from a position within the groove (31) to its threaded interior. This aperture is sized to slidingly receive the ca pin (39) of the clip, which is long enough to extend inwardly from the groove to a position wherein it ma lockingly engage the male threaded end (24) as explained below. The body (36) of the clip desirably has an inner diameter at rest that is less than the outer diameter of the threaded female end (14) adjacent to the annular groove (31) so that the clip, with the tip received in the aperture (33), fits into the groove (31). As noted above, the body (36) of the clip desirably extends more than half way around the circumference of the groove (31). This ensures that the clip will remain in place within the groove; if the clip were shorter, it could simply fall out of the groove because the distance between the two ends of the body would be greater than the diameter of the female end (14) within the groove.

The male threaded end (24) of the punch body is provided with at least one notch, recess or detent (32). In a preferred embodiment, the male end (24) includes a plurality of these detents in a predetermined spacing about the periphery of the male end. In the embodiment shown, four such detents are spaced eguiangularly about the male end's circumference. Each of the detents (32) is adapted to receive a portion of the cam pin (39) therein. Each detent is desirably generally V-shaped in cross section and extends along substantially the entire length of the male end (24) generally parallel to the male end's axis. Aligning the aperture (33) with the detent also aligns the punch assembly. When the cam pin (39) is positioned within a detent, it restricts rotation of the male end with respect to the female end. This serves to lock the threaded rod ends (14, 24) against relative rotation and defines a locked position of the locking means.

The inner end of the cam pin (39) can be of any appropriate shape that will be firmly received within the V-shaped detents (32). A particularly preferred configuration includes a generally V shaped end sized to be received within the detents. The angled walls of each detent may serve as an inclined plane or ramp along which the angled end of the cam pin may ride. By applying sufficient torque, the cam pin may be urged along a wall of a detent until it disengages from the detent. As the cam pin follows the wall, it is urged radially outwardly through the aperture (33) in the female threaded end into the position shown in FIG. 5. The clip (30) is desirably formed of a springy metal, as noted above, so that it may be resiliently deformed to permit the cam pin to so move.

In the locked position the spring clip (30) extends inwardly through the aperture (33). The inner circumference of the punch guide is of a dimension such that the guide (40) holds the spring clip (33) in position within the aperture (33) so that the clip (30) is in the locked position when the guide (40) is positioned over the punch members (10, 20). The punch guide (40), therefore, acts as a further locking mechanism to lock the punch assembly into a desired length. The thread diameter and pitch and the number of grooves determine the amount of length added to the punch tip (22) by turning the threaded portions of the assembly with respect to each other.

In practice, the punch assembly is used to punch items having a desired shape from a larger workpiece in a manner well known in the art. After the punch tip has worn and become dull due to repeatedly striking a workpiece, the punch assembly is removed from its turret or machine for sharpening. The punch assembly is disassembled by axially sliding the punch guide (40) away from the shaft of the punch body (20), as explained in detail above. With the punch guide removed, the punch tip (22) can then be sharpened. After sharpening, the length of the punch is shortened by whatever length was ground off. To compensate for this lost length, the punch holder (10) and punch body (20) are axially rotated in opposite directions. The rotating process causes the cam pin (39) of the wire clip to exit the detent (32) and slide along the groove until it enters the next detent. The motion of the clip entering a detent produces a "click" sound which alerts the user that the clip has entered a detent. As the thread diameter and pitch, as well as the location and number of grooves, will all be known before the assembly is used, the length the punch is increased by rotating the two threaded members of the punch will be predetermined. Thus, the user can adjust the length of the punch as needed simply by counting the number of "clicks". This process is repeated until the punch reaches the desired length. The punch assembly will be aligned and ready for use when the aperture is aligned with a detent. The punch assembly is then reassembled by sliding the guide back onto the shaft of the punch body and the punch assembly can be employed once again (FIG. 3).

While a preferred embodiment of the present invention has been described, it should be understood that various changes, adaptation and modifications may be made therein without departing from the spirit of the invention and the scope of the appended claims.

What is claimed is:

1. A punch assembly for use in a punch press, the assembly including a punch comprising a pair of elongated rods having mating respective male and female threaded ends co-acting to enable the length of the punch to be altered by rotating one rod with respect to the other, one of the rods having at its other end a punch tip, and a punch guide having a bore axially slidingly receiving the punch, the punch assembly including releasable lock means for locking the threaded ends against relative rotation and including means movable between a locked position in which said threaded rod ends are locked against relative rotation and an unlocked position permitting said relative rotation for adjusting the length of the punch, and position maintaining means carried by the punch guide for maintaining the lock means in its locked position when the punch is operatively positioned in the punch guide.

2. The punch assembly of claim 1 wherein said female threaded end comprises an internally threaded circumferential wall having an aperture therethrough, and wherein said male end includes a recess alignable during rotation thereof with said aperture, the lock means comprising a cam pin having a portion insertable generally radially through the aperture and into locking contact with the recess of the male end to lock the threaded ends against relative rotation.

3. The punch assembly of claim 2 wherein said position maintaining means comprises an interior surface carried by the punch guide and positioned to engage and prevent the locking pin from moving into its second position when the punch is operatively positioned in the guide.

4. The punch assembly of claim 3 wherein said threaded female rod end includes an exterior annular groove formed therein and within which is located said aperture, and wherein the locking pin includes a generally "C" shaped wire clip bearing said cam pin at one end, said clip being shaped to be retained within said groove.

5. The punch assembly of claim 4 wherein said clip is of springy metal and extends more than half way around the circumference of the groove, the clip having an inner diameter at rest that is less than the outer diameter of the threaded rod end adjacent the groove, whereby said clip, with the tip received in said aperture, snaps into said groove.

6. The punch assembly of claim 5 wherein said male end comprises a plurality of recesse equally spaced about its circumference and sized to consecutively receive and release the pin as the male threaded end is rotated with respect to the female end, whereby the length of the punch is adjusted a finite, predetermined amount as the pin moves from one recess to the next.

7. The punch assembly of claim 6 wherein the spring metal clip is sized to urge the pin to snap into the consecutive recesses with an audible clicking sound as the male threaded end is rotated with respect to the female end, thereby signaling to an operator, by the number of clicks, the change in length of the punch.

8. The punch assembly of claim 6 wherein the clip may be urged out of a recess by applying sufficient torque to the male threaded end with respect to the female end.

9. The punch assembly of claim 3 wherein the punch guide includes a bore bearing said interior surface, the bore being sized to closely receive the female end of the punch and to prevent the cam pin from withdrawing from the recess carried by said threaded male rod end.

10. A punch assembly for use in a punch press, the assembly including a punch comprising a pair of elongated rods, the first of which has an exteriorly threaded male end and a second of which has a female end including an exterior annular groove formed therein and having an internally threaded circumferential wall that is threadingly receptive of the threaded male end of the first rod such that the length of the punch formed by the two rods threaded together may be altered by rotating one rod with respect to the other, one of the rods having at its other end a punch tip, the punch including means for releasably locking the rods together against rotation of one with respect to the other, said means comprising an aperture formed through said circumferential wall, and a recess formed in the threaded male end and alignable during rotation thereof with the aperture and the female rod end, a locking pin having a portion insertable through the aperture and into locking contact with the recess of the male end, and means for resiliently retaining the locking pin in said aperture comprising a generally "C" shaped wire clip bearing said pin at one end, said clip being of springy metal and extending more than half way around the circumference of the groove and being shaped to be retained within said groove, and having an inner diameter at rest that is less than the outer diameter of the threaded rod end adjacent to the groove, whereby said clip, with the tip received in said aperture, snaps into said groove, the assembly including stripper means to strip a metal workpiece away from the punch tip during a return stroke of the punch tip in a punching operation, the stripper means comprising a tubular sheath within which is received the rod bearing the punch tip, the stripper means including a stripper plate at its end having an orifice through where the punch tip protrudes in a punching operation, wherein adjustment of the length of the punch by rotating one of the punch rods with respect to the other adjusts the distance by which the punch tip protrudes from the punch plate in a punching operation.

* * * * *